US007390447B1

(12) United States Patent
Clark et al.

(10) Patent No.: US 7,390,447 B1
(45) **Date of Patent: *Jun. 24, 2008**

(54) MOLDED THIN-LAYER LIGNOCELLULOSIC COMPOSITES MADE USING HYBRID POPLAR AND METHODS OF MAKING SAME

(75) Inventors: Randy Jon Clark, Klamath Falls, OR (US); Kenneth Dale Kiest, Selah, WA (US); Michael Jay Henry, Yakima, WA (US)

(73) Assignee: JELD-WEN, Inc., Klamath Falls, OR (US)

( * ) Notice: Subject to any disclaimer, the term of this patent is extended or adjusted under 35 U.S.C. 154(b) by 329 days.

This patent is subject to a terminal disclaimer.

(21) Appl. No.: 10/856,683

(22) Filed: May 28, 2004

Related U.S. Application Data

(60) Provisional application No. 60/474,435, filed on May 30, 2003.

(51) Int. Cl.
*B27N 5/00* (2006.01)

(52) U.S. Cl. ..... 264/120; 264/109

(58) Field of Classification Search ..... None
See application file for complete search history.

(56) References Cited

U.S. PATENT DOCUMENTS

| | | | |
|---|---|---|---|
| 619,676 | A | 2/1899 | Cronin |
| 670,939 | A | 4/1901 | Rapp |
| 877,922 | A | 2/1908 | Gager |
| 1,183,842 | A | 5/1916 | Alling |
| D132,040 | S | 4/1942 | Cummings |
| 2,343,740 | A | 3/1944 | Birmingham |
| 2,682,083 | A | 6/1954 | Patton |
| 2,797,450 | A | 7/1957 | Ropella |
| 2,831,793 | A | 4/1958 | Elmendorf |
| 3,098,781 | A | 7/1963 | Greten |
| 3,121,263 | A | 2/1964 | Binner |
| 3,212,948 | A | 10/1965 | McMahon |
| 3,308,013 | A | 3/1967 | Bryant |
| 3,440,189 | A | 4/1969 | Sharp et al. |
| 3,484,994 | A | 12/1969 | Ashby et al. |
| 3,512,304 | A | 5/1970 | Meuret |
| 3,533,190 | A | 10/1970 | Hilfinger et al. |
| 3,546,841 | A | 12/1970 | Smith et al. |
| D222,775 | S | 12/1971 | Sartori |
| 3,639,200 | A | 2/1972 | Elmendorf et al. |

(Continued)

FOREIGN PATENT DOCUMENTS

| | | |
|---|---|---|
| CA | 57271 | 10/1986 |
| CA | 2 437 826 | 8/2002 |
| DE | 3801486 A1 | 8/1989 |
| EP | 0 049 299 B1 | 4/1982 |
| EP | 0 103 048 A2 | 3/1984 |

(Continued)

OTHER PUBLICATIONS

U.S. Appl. No. 10/426,573, filed Apr. 30, 2003, G. A. Davina et al.

(Continued)

*Primary Examiner*—Mary Lynn F Theisen
(74) *Attorney, Agent, or Firm*—Nelson Mullins Riley & Scarborough, LLP

(57) ABSTRACT

Thin-layer lignocellulosic composites made using hybrid poplar and methods for the manufacture of such thin-layer composites are disclosed. Also described is a process for making thin-layer lignocellulosic composite door skins using hybrid poplar wood fiber.

18 Claims, 2 Drawing Sheets

U.S. PATENT DOCUMENTS 3,773,587 A 11/1973 Flewwelling
3,793,125 A 2/1974 Kunz
3,796,586 A 3/1974 Hanlon et al.
3,899,860 A 8/1975 Newell
3,919,017 A 11/1975 Shoemaker et al.
3,987,599 A 10/1976 Hines
D244,736 S 6/1977 Palka
D245,824 S 9/1977 Palka
4,072,558 A 2/1978 Akerson
4,100,138 A 7/1978 Bilow et al.
4,100,328 A 7/1978 Gallagher
4,104,828 A 8/1978 Naslund et al.
4,142,007 A 2/1979 Lampe et al.
4,146,662 A 3/1979 Eggers et al.
4,183,187 A 1/1980 Simard
4,236,365 A 12/1980 Wheeler
4,246,310 A 1/1981 Hunt et al.
4,248,163 A 2/1981 Caughey et al.
4,268,565 A 5/1981 Luck et al.
4,277,428 A 7/1981 Luck et al.
D266,042 S 9/1982 Moore et al.
D266,720 S 11/1982 Moore et al.
4,359,507 A 11/1982 Gaul et al.
4,361,612 A 11/1982 Shaner et al.
4,364,984 A 12/1982 Wentworth
4,388,138 A 6/1983 Brown et al.
4,396,673 A 8/1983 Ball et al.
4,441,296 A 4/1984 Grabendike et al.
D274,107 S 6/1984 Gordon
D274,944 S 7/1984 Coppa
4,503,115 A 3/1985 Hemels et al.
4,544,440 A 10/1985 Wheeler
4,550,540 A 11/1985 Thorn
4,552,797 A 11/1985 Munk et al.
D282,426 S 2/1986 Heimberger et al.
4,579,613 A 4/1986 Belanger
4,610,900 A 9/1986 Nishibori
4,610,913 A 9/1986 Barnes
D286,177 S 10/1986 Case et al.
4,622,190 A 11/1986 Schultz
4,643,787 A 2/1987 Goodman
D292,766 S 11/1987 Palka
4,706,431 A 11/1987 Corvese
4,720,363 A 1/1988 Mayumi et al.
4,811,538 A 3/1989 Lehnert
4,830,929 A 5/1989 Ikeda et al.
4,853,062 A 8/1989 Gartland
4,876,838 A 10/1989 Hagemeyer
D304,983 S 12/1989 Palka
4,896,471 A 1/1990 Turner
4,901,493 A 2/1990 Thorn
4,908,990 A 3/1990 Yoon et al.
4,942,084 A 7/1990 Prince
D311,957 S 11/1990 Hall
D314,242 S 1/1991 Mikolaitis
D314,625 S 2/1991 Hall
5,016,414 A 5/1991 Wang
D319,884 S 9/1991 Hall
5,074,087 A 12/1991 Green
5,074,092 A 12/1991 Norlander
5,075,059 A 12/1991 Green
5,142,835 A 9/1992 Mrocca
5,167,105 A 12/1992 Isban et al.
D335,982 S 6/1993 Brandon
5,219,634 A 6/1993 Aufderhaar
D338,718 S 8/1993 Izzo
5,239,799 A 8/1993 Bies et al.
5,262,217 A 11/1993 Blaauw
5,293,726 A 3/1994 Schick
D349,352 S 8/1994 Csati
5,344,484 A 9/1994 Walsh
5,355,654 A 10/1994 Stanley
5,369,869 A 12/1994 Bies et al.
5,397,406 A 3/1995 Vaders et al.
5,401,556 A 3/1995 Ishitoya et al.
5,443,891 A 8/1995 Bach
5,470,631 A 11/1995 Lindquist et al.
D366,939 S 2/1996 Schafernak
D367,121 S 2/1996 Schafernak
D370,269 S 5/1996 Schafernak
D371,852 S 7/1996 Schafernak
5,543,234 A 8/1996 Lynch et al.
5,554,438 A * 9/1996 Marcinko et al. ..... 428/306.6
D375,424 S 11/1996 Burwick
5,634,508 A 6/1997 Herbst
D382,350 S 8/1997 Lynch
D388,196 S 12/1997 Schafernak et al.
5,766,774 A 6/1998 Lynch et al.
5,782,055 A 7/1998 Crittenden
5,887,402 A 3/1999 Ruggie et al.
5,900,463 A 5/1999 Tanimoto et al.
RE36,240 E 6/1999 Minke et al.
D411,022 S 6/1999 Schafernak et al.
5,950,382 A 9/1999 Martino
D426,645 S 6/2000 Bonomo et al.
6,073,419 A 6/2000 Moyes
6,092,343 A 7/2000 West et al.
6,200,687 B1 3/2001 Smith et al.
6,277,943 B1 8/2001 Sharpeshkar et al. ..... 528/65
6,306,997 B1 * 10/2001 Kuo et al. ..... 527/100
6,309,503 B1 10/2001 Martino
6,312,540 B1 11/2001 Moyes
6,335,082 B1 1/2002 Martino
6,401,414 B1 6/2002 Steel et al.
6,403,000 B1 * 6/2002 Symons ..... 264/109
6,487,824 B1 12/2002 West et al.
6,531,010 B2 3/2003 Puppin
6,588,162 B2 7/2003 Lynch et al.
6,620,459 B2 9/2003 Colvin et al.
6,884,852 B1 4/2005 Klauck et al. ..... 525/458
6,983,684 B2 * 1/2006 Husted ..... 100/92
7,018,461 B2 * 3/2006 Massidda et al. ..... 106/38.24
2001/0001356 A1 5/2001 West et al.
2001/0026862 A1 10/2001 Smith et al.
2001/0052657 A1 12/2001 Jacobsen
2002/0000683 A1 1/2002 Sears et al.
2002/0005602 A1 1/2002 Jacobsen
2002/0068161 A1 6/2002 Matuana et al.
2002/0091218 A1 7/2002 Ford et al.
2002/0106498 A1 8/2002 Deaner et al.
2002/0121327 A1 9/2002 Mente et al.
2002/0121340 A1 9/2002 Mente et al.
2003/0015122 A1 1/2003 Moriarty et al.
2003/0200714 A1 10/2003 Minke et al.
2003/0226329 A1 12/2003 Hubbard
2004/0034113 A1 2/2004 Shidaker et al.
2004/0067353 A1 4/2004 Miller et al.

FOREIGN PATENT DOCUMENTS

EP 0 225 629 B2 6/1987
EP 0 346 640 A1 12/1989
EP 0 688 639 A3 3/1996
GB 2 349 163 A 10/2000
WO WO9800464 * 1/1998
WO WO 02/064337 8/2002
WO WO 2004/076141 A2 9/2004

OTHER PUBLICATIONS

A recorded voluntary standard of the trade published by the U. S. Dept. of Commerce, Commercial Standard CS73-61, Old Growth Douglas Fir, Sitka Spruce and Western Hemlock Doors, 3 pgs., Effective Mar. 20, 1961.

Architectural Woodwork Quality Standards, Guide Specifications and Quality Certification Program, Fifth Edition, The Architectural Woodwork Institute, p. 109.

Cline, M., "Control Mechanisms of Sylleptic Branching in Hybrid Populus," Department of Plant Biology, Ohio State University, web page at www.biosci.ohio-state.edu/~plantbio/seminar/2000abstracts/Cline.html, as available via the Internet and printed on May 28, 2003.

Douglas Fir Doors, E. A. Nord Company, Specifications of Pacific Northwest Fir Doors, 3 pages, 1953.

Elite Doors Brochure—apparently published in Oct. 1987.

"Factory-Fitted Douglas Fir Entrance Doors," U. S. Department of Commerce, Commercial Standard CS91-41, Feb. 10, 1941.

Feirer, John L., Cabinetmaking and Millwork, Chas. A. Bennett Co., Inc., Peoria, IL., pp. 4, 8-14, 145-146, 596-597, 684-687, © 1970.

Goyal, G. et al., "Variability in Pulping and Fiber Characteristics of Hybrid Poplar Trees Due to their Genetic Makeup, Environmental Factors, and Tree Age," Pulping Conference: Proceedings (TAPPI): pp. 857-862, (1997).

Goyal, G. et al., "Variability in Pulping and Fiber Characteristics of Hybrid Poplar Trees Due to their Genetic Makeup, Environmental Factors, and Tree Age," TAPPI, vol. 82, No. 5, pp. 141-147, 1999.

Hartsough, B. et al., "Fiber Recovery with Chain Flail Delimbing/Debarking and Chipping of Hybrid Poplar," International Journal of Forest Engineering, vol. 11, No. 2, pp. 59-67, 2000.

Hechinger Brochure—dated Mar. 16, 1986.

Heilman, P. et al., "High Yield Hybrid Poplar Plantations in the Pacific Northwest," Pacific Northwest Cooperative Extension Bulletin, No. PNW356 (revised), 1995.

Hernandez, R. et. al., "Selected Mechanical Properties of Fast-Growing Poplar Hybrid Clones," Wood and Fiber Science, vol. 30, No. 2, pp. 138-147, 1998.

Hinckley, T. et al., "Scaling up from Leaf to Stands: Coupling Ecophysiological Models with Remote Sensing in Plantation Populus, Deciduous Broadleaf and Old-Growth Pseudotsuga Menziesii, Evergreen Needleleaf," web page at http://nigec.ucdavis.edu/publications/annual99/western/WRHinckley0.html, as available via the Internet and printed on May 28, 2003.

Kretschmann, D. et al., "Structural Lumber Properties of Hybrid Poplar," Forest Products Laboratory, USDA Forest Service, No. FPL-RP-573, 9 pages, 1999.

Lloyd, William B., "Millwork Principles and Practices, Manufacture-Distribution-Use," Cahners Publishing Company, Inc., Chicago, IL., in assoc. with The National Woodwork Manufacturers Association, Inc., pp. VI-XV, 192, 241, 116-117, 167, 173, dated 1966.

Masonite Brand Door Facings—Brochure, 1987.

Mercer, Henry C., Sc. D., "Ancient Carpenter's Tools," The Bucks County Historical Society, Doylestown, PA, pp. 131-133, 1960.

Peters. J. et al., "Flexural Properties and Utilization Options for Hybrid Poplar Clones," Proceeding of the ASAE/CSAE-SCGR Annual International Meeting, Toronto, Ontario, Canada, 20 pages, Jul. 18-21, 1999.

Peters, J. et al., "Selected Properties of Hybrid Poplar Clear Wood and Composite Panels," Forest Products Journal, vol. 52, No. 5, pp. 45-54, May 2002.

Quality Doors Brochure—dated 1988.

Roffael, E., "Poplar Wood as Raw Material for Wood-Based Panels and Pulp Manufacture," WKI-Mitteilung, vol. 514, pp. 2910-2920, 1990.

Stanton, B. et al., "Hybrid Poplar in the Pacific Northwest: The Effects of Market-Driven Management," J. of Forestry, vol. 100, No. 4, pp. 28-33, 2002.

Sweet's Catalog, Section 8.3/50, p. 7, 1981.

Sweet's Catalog, Section 8.3/MO, p. 3, door in center of page, 1981.

Tabbush, P. et al., "Hybrid Poplars: Present Status and Potential in Britain," Forestry, vol. 71, No. 4, pp. 355-364, 1998.

Technology Transfer, "Drought Tolerance of Trees Probed," web page at http://www.ornl.gov/ORNLReview/rev27-12/text/tramain.html, as available via the Internet and printed on May 28, 2003.

"The New Mission Series," product brochure by Nord, Part of the JELD-WEN family, 300 W. Marine View Drive, Everett, WA 98201-1030, 2001.

Visador Brochure—date unknown.

Zhou, D., "A Study of Oriented Structural Board made from Hybrid Poplar," Holz als Roh-und Werkstoff, vol. 48, pp. 293-296, 1990.

Article from PanelWorld, Sep. 2006, entitled Gutex Operation Implements New Process in Wood-Fiber Insulating Board Plant.

* cited by examiner

MOLDED THIN-LAYER LIGNOCELLULOSIC COMPOSITES MADE USING HYBRID POPLAR AND METHODS OF MAKING SAME

RELATED APPLICATIONS

This application claims priority to U.S. Provisional Patent Application Ser. No. 60/474,435, filed May 30, 2003. The disclosure of U.S. Provisional Patent Application Ser. No. 60/474,435 is hereby incorporated by reference in its entirety herein.

FIELD OF THE INVENTION

The present invention relates to thin-layer composites made using hybrid poplar and the manufacture thereof.

BACKGROUND

Wood-based building structures may be solid wood, or may be made as a wood composite. For example, door skins may be formulated as wood composites that are molded as thin layers and then adhesively secured to the underlying door frame to provide a water-resistant outer surface. Generally, door skins are made by mixing wood fiber, a resin binder, and a wax, and pressing the mixture under conditions of elevated temperature and pressure to form a thin-layer wood composite which is then adhered to the underlying door frame.

Due to the decreasing availability and increased cost of wood, there is a need to reduce the amount of wood used from traditional sources for the manufacture of wood composite building structures such as door skins. Also, due to ever increasing environmental concerns, there is a need to minimize the use of wood from natural forests and instead, to utilize sources of wood from reserves that are more easily replenished. Also, door skins of reduced quality may result when the source of wood fiber is not consistent. Thus, there is a need to develop alternative sources of wood of suitable quality and availability for the production of high quality door skins and other thin-layer composites.

SUMMARY

Embodiments of the present invention provide molded thin-layer composites made from hybrid *Populus* ("hybrid poplar") wood fiber and methods for making such structures. In an embodiment, the present invention comprises a thin-layer lignocellulosic composite comprising hybrid poplar fiber and a resin.

Another embodiment of the present invention comprises a method for making a thin-layer lignocellulosic composite comprising pressing a thin-layer lignocellulosic composite such that the final composite comprises a pre-determined amount of hybrid poplar wood fiber. For example, one embodiment comprises a method for making a thin-layer composite comprising a predetermined amount of hybrid poplar fiber comprising the steps of: (a) forming a mixture comprising a refined lignocellulose fiber comprising a predetermined amount of hybrid poplar fiber and a resin; (b) pre-pressing the mixture into a loose mat; and (c) pressing the mat at an elevated temperature and pressure and for sufficient time to form a thin-layer lignocellulosic composite. The thin-layer composite may comprise, for example, a door skin.

Various embodiments of the present invention may provide certain advantages. For example, because hybrid poplar wood fiber can be cultivated specifically for production of wood-based products, it can provide a more consistent source of wood fiber than wood from traditional sources. Thus, the hybrid poplar-based thin-layer composites of the present invention may exhibit improved consistency of the final product. Also, because of the consistency of the fiber, there may be less need to adjust steps during the manufacture of such composites as is often required with conventional wood chips.

Also, in certain embodiments, the hybrid poplar thin-layer composites may be made at a lower density than thin layer composites made using conventional sources of wood. Formulation of a lower density thin-layer composite may be associated with numerous improvements in the final product, and in the manufacturing process. For example, one advantage associated with the method of preparing the thin-layer lignocellulosic composites of lower density can be a significant reduction in manufacturing workload for the step of refining the wood fibers. Also, there may be a reduction in force exerted by thin-layer lignocellulose composites of reduced density as a result of moisture-induced shrinking and swelling. Thus, products made with such composites may exhibit reduced warping.

Yet another advantage for certain embodiments of the thin-layer lignocellulosic composites of the present invention is that thin-layer lignocellulosic composites comprising hybrid poplar fiber may exhibit more dimensional stability to changes in moisture.

Another advantage associated with preparing thin-layer lignocellulosic composites using hybrid poplar can be a significant reduction in the amount of resin required per thin-layer composite. The reduction in resin allows for savings in materials used, and may provide reduced chemical emissions per unit product. As an additional advantage, the thin-layer composites made using hybrid poplar fiber may display improved surface quality and appearance as compared to a thin-layer composite made using traditional sources of wood.

When applied to the manufacture of door skins, certain embodiments of the methods and compositions disclosed herein may include one or more of the following:

1. Preparation of thin-layer wood composite door skins from a sustainable, easily renewable wood source;
2. Preparation of door skins of improved quality;
3. Preparation of door skins at reduced cost;
4. Reduction in density of the door skin resulting in less wood fiber being used per door skin and reduced manufacturing costs;
5. Reduced chemical emissions during manufacturing due to lower resin content;
6. Use of a consistent source of raw materials resulting in fewer modifications of the processing steps; and
7. Reduction in shipping and handling costs for door skins that weigh less and have less breakage.

The present invention may be better understood by reference to the description and figures that follow. It is to be understood that the invention is not limited in its application to the specific details as set forth in the following description and figures. The invention is capable of other embodiments and of being practiced or carried out in various ways.

DETAILED DESCRIPTION

Figure 1:
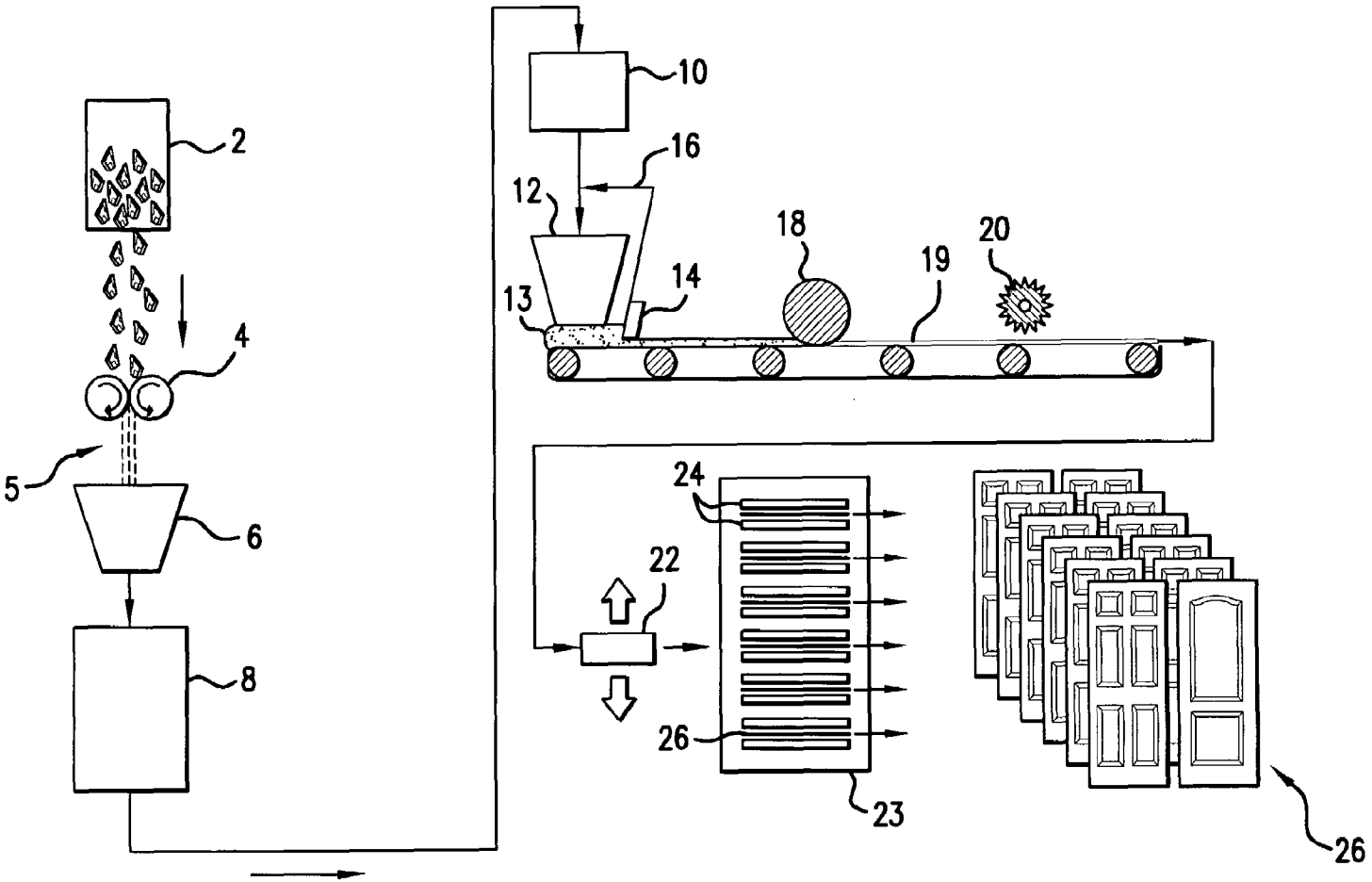
FIG. 1 shows an overview of a method used to make door skins in accordance with an example embodiment of the present invention.

Embodiments of the present invention provide molded thin-layer lignocellulosic composites made using hybrid poplar and methods of making such structures. The present invention may be embodied in a variety of ways. In one embodiment, the present invention comprises a thin-layer lignocellulosic composite comprising hybrid poplar fiber and a resin.

Embodiments of the present invention also comprise methods for making molded thin-layer lignocellulosic composites using hybrid poplar. In one embodiment, the present invention comprises a method for making a thin-layer composite comprising a predetermined amount of hybrid poplar fiber. A mixture may be formed comprising a refined lignocellulose fiber. Such fiber may comprise, for example, a predetermined amount of hybrid poplar fiber and a resin. A wax and/or other minor components such as an internal release agent, may also be added to the fiber. The mixture may be pressed into a loose mat. The mat may be further pressed at an elevated temperature and pressure and for sufficient time to form a thin-layer wood composite.

The thin-layer composite may comprise a variety of shapes. For example, the composite structure may comprise a door skin, a thin-layer composite for a panel (such as might be used for a door or wall), or another suitable structure. As another example, the thin-layer composite may be shaped for use as interior or exterior millwork such as casing for a door frame or a window frame, base board, crown molding, fascia, soffits, and other decorative moldings.

Hybrid poplar provides a source of lignocellulose fiber that can be cultivated to provide a readily available source of wood of consistent quality. The contribution of hybrid poplar to the overall amount of lignocellulose may be varied depending upon the thin-layer composite being formulated. In one embodiment, the hybrid poplar fiber comprises the total lignocellulose fiber used in the thin-layer composite. In alternative embodiments, the hybrid poplar fiber may range from about 20% to about 75%, or from about 40% to about 75%, or from about 40% to 55%, of the total lignocellulose fiber as measured in dry weight used in the thin-layer composite.

The thin-layered lignocellulosic composites of the present invention may comprise a range of lignocellulose fiber concentrations. Thus, in an embodiment, the composite mixture may comprise about 50% to about 99% by weight of lignocellulose fiber. In another embodiment, the composite mixture may comprise about 80% to about 95% by weight of lignocellulose fiber.

The resin may be a formaldehyde-based resin, an isocyanate-based resin, other thermoplastic or thermoset resins, or other suitable material. Formaldehyde-based resins typically used to make wood composite products include phenol-formaldehyde, urea-formaldehyde, or melamine-formaldehyde resins. Phenol-formaldehyde resins provide good water-resistance, but may require a high temperature cure. Also, phenol-formaldehyde resins are sensitive to the amount of water in the wood as excess water can inhibit the high temperature cure. Urea and melamine-formaldehyde resins do not require a high temperature cure, but may require a higher resin content to provide comparable water-resistance in the thin-layer composite product. For example, for the manufacture of door skins, Dynea's urea formaldehyde resin #11A6117, or Georgia Pacific urea formaldehyde resin #610A12, may be used. Alternatively, isocyanate resins may be used. As compared to thin-layer composites made using phenol-formaldehyde resins, thin-layer composites that utilize high-temperature pressed isocyanate resin binder may display improved surface appearance and increased stability to moisture. In an embodiment, the thin-layer composite may comprise an isocyanate resin as described in commonly owned, co-pending U.S. patent application Ser. No. 10/785,559, entitled "Thin-Layer Lignocellulose Composites Having Increased Resistance to Moisture and Methods of Making Same," filed Feb. 24, 2004, which is hereby incorporated by reference in its entirety.

The amount of resin used in embodiments of the present invention may be varied based on the type of resin being used, the type of lignocellulose fiber in the composite, the moisture level in the lignocellulosic fibers, and the type of thin-layer composite being made. For example, in one embodiment comprising a wood-based door skin, the amount of resin may range from about 1 to 25% by weight of the composite. In other embodiments, the resin may range from about 3 to 15% by weight of the composite, or from about 5 to 10% by weight of the composite.

The lignocellulosic composite mixture may comprise at least one type of wax or other suitable material. The wax may impart additional short-term water repellency to the wood composite. The type of wax used is not particularly limited, and waxes standard in the art of wood fiber processing may be used. In an embodiment, the wax increases the water repellency of the wood. The wax selected should be stable to the temperatures used for pressing the wood/resin mixture into a thin layer and not adversely affect the aesthetics or subsequent processing (such as priming or gluing) of the wood composite. In an embodiment, the wax may be a natural wax or a synthetic wax generally having a melting point in the range of about 120° F. (49° C.) to about 180° F. (82° C.). Waxes used may include, but are not limited to, paraffin wax, polyethylene wax, polyoxyethylene wax, microcrystalline wax, shellac wax, ozokerite wax, montan wax, emulsified wax, slack wax, and combinations thereof. In one embodiment comprising door skins, the mixture may comprise up to about 2% by weight of wax. In one embodiment, about 0.5% by weight wax is used.

Improved characteristics of refined fiber produced using hybrid poplar wood may result in an improved surface quality for thin-layer lignocellulosic composites made using hybrid poplar, as compared to thin-layer lignocellulosic composites that do not include hybrid poplar. Also, the thin-layer composite may include agents to further improve the surface characteristics of the composite. For example, the thin-layer composites of the present invention may also include a sealing agent (or sealer). In one embodiment, the sealing agent is added to the surface of the mat prior to pressing the mat into a thin-layer. The sealing agent may be added to improve the surface appearance and performance properties of the thin-layer composite. The sealing agent may also allow for faster heat transfer from the die used to press the mat and cure the resin. In an embodiment, the sealing agent may comprise any release agent or thermoset resin, normally diluted with water to less than 50% solids.

The lignocellulosic mixtures may be pressed into thin-layers using flat or molded dies at conditions of elevated temperature and pressure. In an example embodiment of the present invention, the mixture may initially be formed into a loose mat, pre-compressed into a thinner mat, and the mat placed on a die in the press. Because the composite may include amounts of resin that are sufficient to adhere the fibers together, the composite may stick to the surface of the dies that are used to press the mat into the resultant thin layer composite. Thus, the thin-layer composite may be treated to reduce sticking of the thin-layer composite to the surfaces used to press the composite. For example, thin-layer composites may be exposed to a release agent prior to pressing the composite. The release agent may also be used as the sealing agent. In one embodiment, the release agent may be added directly to the lignocellulosic composite mixture as an internal release agent prior to pre-pressing the mixture into a loose mat. Alternatively and/or additionally, the release agent may be sprayed on the surface of the mat before the mat is pressed into a thin layer. In one embodiment, the release agent may comprise an aqueous emulsion of surfactants and polymers. For example, the release agent may comprise compounds used in the door skin manufacturing industry such as, but not limited to, PAT®7299/D2 or PAT®1667 (Wurtz GmbH & Co., Germany).

The release agent may be clear, or it may include a pigment. For example, a tinted release agent sprayed on the outer surface of a door skin may facilitate subsequent priming or painting of the door. In this way, an even coloring may be applied to the thin-layered lignocellulosic composite.

Other strategies may be used to reduce sticking of the lignocellulosic composite to the dies used for making the resultant thin-layer composite. For example, at least one surface of the die used to press the mat may be exposed to an anti-bonding agent. Exposing the die to an anti-bonding agent may comprise coating at least one of the dies used to press the mat with an anti-bonding agent. In an embodiment, coating the die may comprise baking the anti-bonding agent onto the die surface.

An anti-bonding agent used to coat the die surface(s) may be distinct from the release agent used to coat the mat. The anti-bonding agent used to coat the die surface(s) may comprise agents such as silane or silicone based chemicals that are known to be effective coating agents. These anti-bonding agents may not be particularly suitable for spraying directly on the wood mat (or incorporating into the wood composite) since compounds comprising silane or silicone may interfere with later finishing of the wood product by priming and/or painting. In an example embodiment, the anti-bonding agent used to coat the die surface may comprise anti-bonding agents known in the art of die pressing such as, but not limited to, CrystalCoat MP-313 and Silvue Coating (SDC Coatings, Anaheim, Calif.), Iso-Strip-23 Release Coating (ICI Polyurethanes, West Deptford, N.J.), aminoethylaminopropyltrimethoxysilane (Dow Corning Corporation), or the like.

Thin-layer composites made using hybrid poplar may have a number of advantages as compared to thin-layer composites made using conventional wood sources. In one embodiment of the present invention, the thin-layer composites may comprise a reduced density as compared to thin-layer composites made using wood from conventional sources. The reduction in density may result at least in part from a reduction in the density of the actual fiber, and also from the ability to use less fiber per composite. For example, the bulk density of hybrid poplar may be less than fiber made from pine chips, but may be about the same as fiber made from yellow poplar chips or other species. In one embodiment, the density of the thin-layer lignocellulose composite made using hybrid poplar may be reduced by at least 15% as compared to composites made using other types of wood. In another embodiment, the density of the thin-layer composite may be reduced by at least 25% compared to composites made using other types of wood.

For example, in one embodiment according to the present invention, the final density of thin-layer composite door skins may be less than 58 pounds per cubic foot (pcf) (929 kg/m$^3$). Alternatively, the final density of thin-layer composite door skins of the present invention may be less than 56 pounds per cubic foot (pcf) (897 kg/m$^3$), or less than 51 pcf (817 kg/m$^3$). In one embodiment, the thin layer composites of the present invention may comprise door skins having a density ranging from 45 pcf (721 kg/m$^3$) to 58 pcf (929 kg/m$^3$). In another embodiment, the thin layer composites of the present invention may comprise door skins having a density ranging from about 51 pcf (817 kg/m$^3$) to 56 pcf (897 kg/m$^3$).

By using a cultivated source hybrid poplar, wood may be harvested in a manner to provide a high level of consistency in the wood. For example, in an embodiment, trees selected for harvest may be of a certain range in age, size, moisture level, and the like, to provide a wood that is very similar from tree to tree. This consistency of raw materials can translate into an improved wood fiber, and ultimately, an improved thin-layer lignocellulosic product. Thus, in one embodiment, the thin-layer lignocellulosic composites of the present invention may comprise an improved fiber quality compared to composites that do not include hybrid poplar fiber.

In one embodiment of the present invention, the improved fiber quality may comprise a more uniform nature of the fiber produced. For example, the improved fiber quality may be associated with fewer fiber bundles, or shives, than thin-layer lignocellulosic composites made with other types of wood. The reduction in shives may be greater than 50%. Alternatively, the reduction in shives may be greater than 25%. In one embodiment, the present invention may comprise door skins of less than 5% shives.

Improved characteristics of fibers produced using hybrid poplar may also allow for a reduction in thickness of the thin-layer lignocellulosic products produced. For example, the thickness of the thin-layer lignocellulosic composite made using hybrid poplar may be reduced by about 25% as compared to thin-layer lignocellulosic composites that do not include hybrid poplar as a source of lignocellulose fiber. Or, the thickness of the thin-layer lignocellulosic composite made using hybrid poplar may be reduced by about 10% as compared to composites that do not include hybrid poplar. In one embodiment, the thin-layer composite may comprise a thickness ranging from about 0.05 inch (1.27 mm) to about 0.5 inch (12.7 mm). Thinner composites may be formed. Thus, in alternate embodiments, the thin-layer composite may comprise a thickness ranging from about 0.08 inch (2.03 mm) to about 0.2 inch (5.08 mm), or from about 0.09 inch (2.28 mm) to about 0.115 inch (2.92 mm). For example, a door skin of the present invention may range from about 0.09 inch (2.28 mm) to about 0.115 inch (2.92 mm) in thickness.

Improved characteristics of the fibers produced using hybrid poplar may comprise a reduction in breakage as compared to thin-layer composites that do not include hybrid poplar as a source of lignocellulose fiber. In one embodiment, the reduction in breakage may be greater than 70% as compared to thin-layer composites that do not include hybrid poplar fiber. In other embodiments, the reduction in breakage may be greater than 50%, or greater than 25%, as compared to thin-layer composites that do not include hybrid poplar fiber.

The improved characteristics of fibers produced using hybrid poplar may comprise a increased resistance to moisture-induced shrinking and/or swelling as compared to thin-layer composites that do not include the hybrid poplar. The linear expansion to humidity changes, as tested via ASTM D1037, shows that using hybrid poplar can reduce the linear expansion by as much as 38%, as for example, for door skins made with 100% hybrid poplar. Or with less hybrid poplar (e.g., door skins made with 30% hybrid poplar), the linear expansion may be improved by 15%.

The thin-layer composites of the present invention may also exhibit reduced force upon shrinking and swelling as compared to thin-layer composites that do not use hybrid poplar wood as a source of lignocellulose fiber. For example, door skins made using the thin-layer composites of the present invention may have less tendency to buckle or warp upon exposure to environmental weathering as compared to denser door skins that do not used hybrid poplar fiber. In an embodiment, the reduction in density of the thin-layer composite is proportional to the reduction in force upon shrinking or swelling. For example, by reducing the density of the thin-layer composite by about 10%, there can be a reduction in the force exerted by the thin-layer composite upon swelling or shrinking by about 10%.

Use of hybrid poplar as a source of lignocellulose fiber can also result in streamlining of several steps during production. In one embodiment, the improved characteristics of the fibers produced using hybrid poplar comprises the ability to make thin-layer composites that use less wood at each step. Because less material is used per thin-layer composite, there may be increased utilization of resources during the manufacturing process and improved properties of the thin-layer composite. Where the thin-layer composite comprises a door skin, there may be a reduction in the amount of lignocellulosic fiber used per door skin. Thus, the door skins of the present invention may comprise a reduction in lignocellulosic fiber per door skin of about 5 to 25%. In an embodiment, a reduction in the amount of lignocellulosic fiber used per door skin may be about 10 to 20%.

The reduction in lignocellulosic fiber per door skin may provide a reduction in work load at various steps in the manufacturing procedure. For example, the reduction in lignocellulosic fiber used per door skin may result in the ability to reduce the rate that the wood chips are sifted to remove fines, thereby allowing for more efficient removal of fines from the wood chips and less fines in the final product. For the purposes of making door skins, fines may be defined as lignocellulose particles that will pass through a 1/16 by 1/16 inch (1.59 by 1.59 mm) mesh screen. In an example embodiment, the rate of sifting the wood chips to remove fines for door skins of the present invention ranges from about 9,100 pounds (4,218 kg) per hour as compared to 10,000 pounds (4,536 kg) per hour for standard 0.125 inch (3.18 mm) door skins made from wood that does not include hybrid poplar as a source of lignocellulose fiber, amounting to a 9% reduction in the rate of sifting for wood chips comprising hybrid-poplar. Thus, in an embodiment, the wood chips comprising hybrid poplar comprise fewer fines than wood chips that do not include hybrid poplar as a source of lignocellulose fiber. In an embodiment, the wood chips used to generate the refined hybrid-poplar wood fiber for thin layer door skins comprise about 2 to 22% fines. In other embodiments, the hybrid poplar wood chips used to generate the refined wood fiber may comprise about 2 to 15% fines, or alternatively, about 2 to 10% fines.

The reduction in lignocellulosic fiber per composite may also be associated with a reduced workload for the refiner used to prepare the lignocellulosic fibers that go into the thin layer composite. For example, the reduction in lignocellulosic fiber used for manufacturing door skins of the present invention may result in embodiments providing a reduction in the workload for the refiner of greater than 5% or alternatively, greater than 10%, or even greater than over 20% per door skin. In an embodiment, the reduction in lignocellulosic fiber per door skin results in a reduction in the workload for the refiner used to refine the wood in the range of about 5% to about 25% as compared to a door skin that does not include hybrid poplar as a source of lignocellulose fiber. The reduction of the workload on the refiner may also correlate to a reduction on wear for the refiner plates, with an associated increase in the amount of higher quality fiber that is produced and less down-time required to replace worn plates.

Hybrid poplar is a semi-hard wood. When refined, hybrid poplar fibers may be shorter and thinner than fibers made from other types of wood, such as pine. The reduction in bulk density of the fiber may result in less lignocellulosic fiber used per thin-layer lignocellulosic composite, and therefore a reduction in the cost of drying the lignocellulosic substrate per composite. For the manufacture of door skins, the reduction in energy costs of drying may range from about 5% to about 20% per door skin. In other embodiments, the reduction in energy costs of drying may range from about 10 to about 20% per door skin.

Also, because the thin-layer lignocellulosic composite of the present invention require less wood than composites that do not include hybrid poplar as a source of lignocellulosic fiber, there may be less resin required per thin-layer lignocellulosic composite. For the manufacture of door skins, the reduction in resin per door skin has the potential advantage of resulting in less resin build up in the blender. In an embodiment, the reduction in resin per door skin ranges from about 3% to about 20% as compared to a door skin that does not include hybrid poplar as a source of lignocellulosic fiber. In other embodiments, the reduction in resin per door skin ranges from about 10% to about 20% as compared to a door skin that does not include hybrid poplar as a source of lignocellulosic fiber.

The reduction in the amount of resin used may also be associated with reduced chemical emissions per thin-layer composite. For the manufacture of door skins, the reduction in resin used per door skin may comprise a reduction in chemical emissions of 3 to 20% as compared to a door skin that does not include hybrid poplar as a source of lignocellulosic fiber. Alternatively, the reduction in resin used per door skin may comprise a reduction in chemical emissions of 10 to 20% as compared to a door skin that does not include hybrid poplar as a source of lignocellulosic fiber.

In one embodiment, thin-layer lignocellulosic composites employing hybrid poplar are less dense and weigh less than thin-layer lignocellulosic composites that do not employ hybrid poplar as a source of lignocellulosic fiber. For example, the less dense door skins of the present invention may weigh less and thus be easier to handle than standard door skins having a density of greater than 61 pounds per cubic foot. In an embodiment, the reduction in the weight per door skin is in the range of about 5% to 25% as compared to a door skin that does not include hybrid poplar as a source of lignocellulosic fiber. Alternatively, the reduction in weight per door skin may range from 5% to about 15%, or in other embodiments, from about 5% to about 10% per door skin.

In an embodiment, because the door skins are less dense than door skins that are made using conventional wood sources, the hybrid poplar door skins of the present invention may comprise a reduction in time to press the mat to the final thickness and a reduction of time for pressing between the dies compared to door skins that do not include hybrid poplar. In an embodiment, the reduction in press time may be about 20% (i.e., about 10 seconds per press cycle). In other embodiments, the reduction in press time may be about 10% (i.e., about 5 seconds or more per press cycle) or about 2% (i.e., about 1 second per press cycle).

Preparation of Thin-Layer Lignocellulose Composite Door Skins

Embodiments of the present invention may comprise the use of alternative wood sources for the manufacture of thin-layer lignocellulosic composites. As used herein, lignocellulose comprises a material containing both cellulose and lignin. Suitable lignocellulosic materials may include wood particles, wood fibers, straw, hemp, sisal, cotton stalk, wheat, bamboo, jute, salt water reeds, palm fronds, flax, groundnut shells, hard woods, or soft woods, as well as fiberboards such as high density fiberboard, medium density fiberboard, oriented strand board and particle board. In an embodiment, the lignocellulosic fiber is refined. As used herein, refined fiber comprises fibers and fiber bundles that have been reduced in size from other forms of a lignocellulose substrate such as, but not limited to, chips and shavings. In one embodiment, the lignocellulosic composites of the present invention comprise wood fiber. Refined wood fiber may be produced by softening the larger wood particles with steam and pressure and then mechanically grinding the wood in a refiner to produce the desired fiber size.

Hybrid poplar trees comprise trees of the *Populus* genus. Hybrid poplar trees have been developed as an alternative wood source suitable for many wood-containing products. These hybrids are generally generated by sexual propagation of trees of two different species (e.g., cottonwood and aspen) and growth of the hybrid from the resulting cuttings or seedling. Subsequently, cuttings from the hybrid tree are used for asexual (clonal) propagation of the hybrid. Several hybrid poplar species have a number of beneficial characteristics, including faster growth, increased resistance to drought, and an increase in sylleptic shoots resulting in increased branching (i.e., increased wood per tree) as compared to trees of the parent type. Also, because the trees are a readily replenished, hybrid poplar plantations provide a source of wood that is consistent in the characteristics of the harvested wood. This results in less variability in processing than when the wood chips are derived from wood of varying type and/or quality.

Hybrid poplar wood is a source of wood that can be well-suited to the manufacture of thin-layer lignocellulosic composites such as door skins and the like. For example, an important parameter for door skin manufacture is consistency. As described above, the use of commercially produced hybrid poplar provides a source of wood chips having a high level of consistency. Fiber that is inconsistent with respect to parameters such as moisture content, lignin content, the amount of bark and other contaminants, can require adjustments to the production process. These adjustments are associated with significant down-time as modifications to the production line are made to accommodate variances in the wood. Also, several types of hybrid poplar have relatively low levels of lignin that can provide easier refining of the fibers. The hybrid poplar trees may be designed to provide other advantages to the process or performance of the lignocellulosic composite, like longer fiber length, decreased extractives, and lower fiber density.

Several types of *Populus* species may be used to produce the wood skins of the present invention. Examples include NM4, Eugeneii, and Crandon obtained from commercial suppliers such as Potlach (Boardman, Oreg.), Greenwood Resources (Portland, Oreg.), and International Paper (Stamford, Conn.).

As used herein, a thin-layer composite comprises a flat, planar structure that may be significantly longer and wide than it is thick. Examples of thin-layer lignocellulosic composites include wood-based door skins that are used to cover the frame of a door to provide the outer surface of the door. Such door skins may be only a few millimeters (mm) thick, but may have a surface area of several square feet or more. For example, a standard door skin that is about 36 inches (0.91 m) wide by about 80 inches (2.0 m) long may be about 0.125 inches (3.175 mm) thick. Alternatively, the thin-layer composite may comprise a panel, such as those used for doors, walls, kitchen cabinets, ceiling tiles, and other structures. Other thin-layer lignocellulosic products may include medium density fiberboard (MDF), hardboard, particleboard, oriented strand board (OSB), and other panel products.

In one embodiment, the thin-layer composite may comprise a door skin. Generally, door skins may range in size from about 97 inches (2.46 m) in length by 49 inches (1.24 m) in width to about 60 inches (1.52 m) in length by 9 inches (0.23 m) in width. In an embodiment, the door skin may be sized to fit a standard door, or about 36 inches (0.91 m) wide by about 80 inches (2.0 m) long. Still, door skins of other sizes such as panels up to about 12 feet or more in length may be manufactured using the methods and systems of the present invention depending on the use for the final products.

FIG. 1 shows an overview of a general method used to prepare door skins. As shown in FIG. 1, a source of lignocellulosic fiber, such as a selected wood species 2, may be ground by a refiner 4 to prepare fibers 5 of a uniform size. In one embodiment of the present invention, the selected wood species comprises hybrid poplar wood. Wax may then be added and/or the lignocellulosic fibers may be at least partially dried 6. At this point, the fiber/wax blend may then be mixed with an appropriate binder resin (e.g., using atomization), until a uniform mixture is formed 8 and the preparation may be stored 10 until further processing. Resin may also be added to the fiber after the fiber storage bin and before the mixture is formed.

The fiber/resin mixture may then be processed by the former 12 into a loose mat 13. The loose mat 13 may then be pre-shaped using a shave-off roller 14 and pre-compressed using a pre-compressor 18 to mat 19 having a density of about 6-15 pounds per cubic foot. At this point, the excess mat material removed by the shaver may be recycled 16 back to the former. After further trimming to the correct size and shape, as for example, using a saw 20, the pre-pressed mats are transferred to a loader 22 to be loaded into a platen press 23, and each mat is compressed between two dies 24 under conditions of increased temperature and pressure. For example, standard pressing conditions may comprise pressing at 290° F. at 1200 psi for 10 seconds followed by 20 seconds at 500 psi (i.e., about 143° C. at 84.3 kg/cm$^2$ for 10 seconds followed by 20 seconds at 35.2 kg/cm$^2$). Generally, a recessed (female) die is used to produce the inner surface of the door skin, and a male die shaped as the mirror image of the female die is used to produce the outside surface of the door skin. Also, the die that forms the side of the door skin that will be the outer surface may include an impression to create a wood grain pattern. After cooling, the resulting door skins 26 are mounted onto a doorframe to produce a door using a standard adhesive and employing methods standard in the art.

Figure 2:
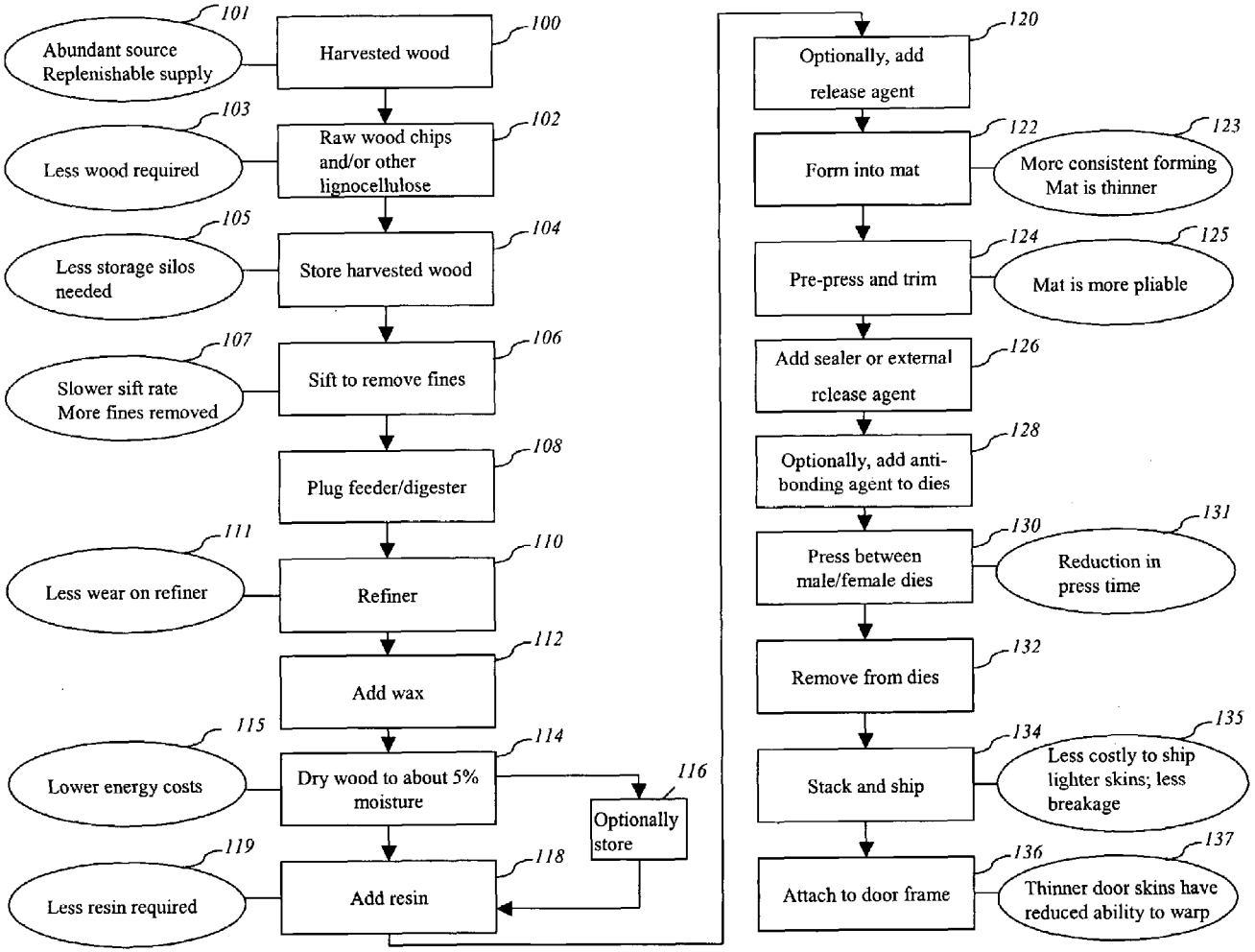
FIG. 2 shows a flow chart describing advantages (shown as ovals) provided at various steps of the manufacturing process (shown as rectangles) for making door skins from hybrid poplar wood fiber in accordance with an example embodiment of the present invention.

FIG. 2 shows an example method of manufacturing door skins according to the present invention. FIG. 2 also shows advantages that may be obtained by using a method according to the present invention. The advantages shown, of course, are not found in every embodiment of the present invention. As shown in FIG. 2, an initial step in the manufacture of door skins may be the harvesting of trees used as a source of wood fiber 100. As an initial advantage in the production process, hybrid poplar plantations may provide an improved source of wood chips for the production of wood skins 101. Thus, because hybrid poplar typically grows faster than the parent strains, the trees may be grown on plantations as a sustainable and renewable resource. Generally there is no limitation on the size of the *Populus* tree that can be used, except that trees that are too small may have an excess of bark in the wood chip mix.

Once the wood has been harvested, it can be chipped to provide a substrate for the manufacture of door skins 102. In an embodiment of the present invention, the method may provide for a reduction in the amount of wood required per door skin 103.

Hybrid poplar trees can have a relatively high moisture content. In some cases, the hybrid poplar may have 50% water or more. Once the trees are cut by the chopper and chipped, the poplar chips may be stored in an indoor storage unit, such as a trailer or the like to prevent the development of mold which can be associated with changes in the pH and buffer capacity of the wood chips. After being put in the trailer, the wood may be transferred by truck to the wood skin production facility. Alternatively, the wood can be dried on-site, at the plantation, prior to shipping. Drying the wood on site simplifies storage and provides a lighter product for shipping.

Once the wood chips are shipped to the production plant, the hybrid poplar chips may be stored in a silo separate from other wood chips used for the door skin until production begins 104. Alternatively, the hybrid poplar wood chips can be mixed with wood chips from other sources. In one embodiment, the hybrid poplar chips may be dried prior to mixing with the other wood chips. Alternatively, drying may occur previously (such as at the plantation) or in subsequent steps. Because the hybrid poplar wood chips can produce skins of reduced density, there may be less wood needed per door skin and thus, fewer silos to store the wood 105.

Also in an embodiment, the present invention may realize an advantage at the step 106 of sifting the wood chips to select for particles of the correct size. To produce high quality door skins, wood chips may be sifted to remove fines. When wood chips are sifted through a 1/16×1/16 inch screen at a rate of 10,000 lbs (4,536 kg) wood chips/hour, the sifted chips comprise about 10 to 30% fines. In the present invention, because less wood is needed to make thinner door skins, the sifting lines may be run at a slower rate 107. In an embodiment, the sifting lines are run at a rate that is about 9% slower than the rate used to make door skins that do not use hybrid poplar wood. Running the lines at the slower rate of 9,100 pounds (4,128 kg) of wood chips per hour provides for more efficient sifting, thereby reducing the percentage of fines in the sifted product to a final value of 2 to 22% by weight fines.

Next, a plug feeder screw or rotary valve may be used to control the amount of sifted wood product that will go into a digester 108. The digester softens the wood chips under high steam pressure and high temperature. Water may also be added to the digester to add in conditioning the chips. Once digested, the chips are processed by a refiner 110. If the hybrid poplar wood is not dried prior to the plug feeder stage, the excess moisture may be squeezed from the wood as the chips are fed through the plug feeder. Alternatively, the excess water may be adsorbed by other dry wood that may be added to the mix, thereby reducing or preventing water from exiting the plug feeder housing. Thus, in an embodiment, the plug feeder may allow for wood chips having pre-defined moisture content. In an embodiment, the moisture content of wood passing through the plug feed is less than about 30%, with the remainder of the water being drained off or adsorbed by other dry wood in the mix.

The reduction in wood used per skin may be associated with a reduction in the wood being processed by the refiner 111. In the refiner, the wood is moved across a series of plates with engineered grooves, each of which are separated by a few thousandths of an inch. The plates are etched such that the wood is thinned out as it moves from the center to the edges of the refiner to provide individual fibers or fiber bundles for the preparation of the door skins. A substantial cost associated with the manufacture of door skins can be the cost of replacing the refiner plates. Such down-time can significantly add to the cost of production. The reduction in workload on the refiner may be associated with reduced manufacturing costs for replacement of worn plates, and a reduction in down-time for refiner maintenance and repair. The reduction in refiner workload per door skin may comprise about 5 to 20%, or alternatively, about 10 to 15%.

An additional advantage of the use of hybrid poplar wood chips may be the uniform nature of the fiber produced. Thus, in an embodiment, the wood skins of the present invention comprise fewer fiber bundles, or shives. Shives are defined to be large fiber bundles greater than about 0.006 inches (0.15 mm) wide. For example, in one embodiment, the reduction in shives may range from about 25% to about 50%.

As described above, wax may be added to the wood fibers 112 to impart short-term water repellency to the wood composite, and the wood dried 114. In an embodiment, the present invention may provide for reduced energy costs associated with drying the wood at this step 115 since less wood is required per door skin. Also, the use of hybrid poplar fibers may be associated with having the production line run faster, thereby providing increased efficiency at the same rate of energy consumption.

After drying, the wood/fiber mixture may be stored 116 prior to adding the resin 118. Alternatively, the wax/wood fiber mixture may be blended with resin 118 prior to storing. In yet another embodiment, the resin is added prior to drying the wood and/or adding wax. Once the resin and wax have been added to the refined fiber, the fiber/resin/wax mixture may be formed into a loose mat 122. In some cases, a release agent may be added to the fiber/resin/wax mixture 120 or sprayed on the mat.

The present invention may allow for the use of reduced amounts of resin per door skin 119. In an embodiment, the reduction in resin may comprise at least 5% less resin per door skin. In other embodiments, the reduction in resin may comprise at least 10% or even greater than 15% per door skin. Using less resin per door skin can result in a lower cost per door skin. In addition, the reduction in resin can result in lower chemical emissions (e.g., formaldehyde and methanol) from the manufacturing facility.

In addition to the advantage of using less material, reducing the amount of resin may result in less resin build-up in the blender used to mix the resin with the wood fibers and wax. Over time, plates in the blender can develop a build-up of resin that may cure on the plates. When manufacturing door skins, significant down-time can result when the blender plates need to be cleaned. In addition to adding down-time to the manufacturing process, the particles of resin that become cured onto the blender plates may eventually become dislodged and fall into the wood mixture. These resin particles do not mix into the wood fibers, but remain as discrete solid particles that can form a spot or blemish on a certain percentage of the pressed door skins. This can result in door skins of reduced quality. By reducing the extent of resin build up on the blender plates, particulate build-up may be reduced, thereby resulting in door skins of improved quality.

As described above, in some cases, a release agent may be added to the fiber/resin/wax mixture 120 or sprayed on the mat. For the manufacture of door skins, an internal release agent may comprise about 0.1% to about 8% by weight of the composite. The internal release agent may be added as a solution (typically about 25% to 50% solids) and blended with the wood fiber, resin and wax. Adding the release agent as part of the wood composite may require the use of more release agent than when only the surface of the composite is exposed, but may be justified since the production set up does not require equipment to spray the release agent onto the mat.

Alternatively and/or additionally, the release agent may be sprayed on the surface of the composite prior to pressing the composite as a thin layer 126. In one embodiment, the release agent acts as a sealer. In an example embodiment, the amount of release agent sprayed on to the mat surface may range from about 0.1 to about 8.0 grams solids per square foot (1.1 to 86.1 grams per square meter) of mat surface. Thus, for the manufacture of thin-layer door skins, the amount of release agent sprayed on the mat surface may comprise about 4 grams solids per square foot (43 grams per square meter) of mat surface sprayed as an aqueous solution of about 25% release agent on to the mat surface.

Thus, the thin-layer lignocellulosic composites of the present invention may comprise wood fibers and resin as well as wax and/or a release agent. For example, in an embodiment, the present invention comprises a thin-layer wood composite door skin comprising a mixture of: (i) hybrid poplar fiber; (ii) an organic resin; (iii) optionally, at least 0.5% by weight of a wax; and (iv) optionally, at least 0.1% internal release agent by weight and/or at least 0.1 grams release agent per square foot (1.1 grams per square meter) on the surface of the composite.

At this point, the furnish (i.e., the wood/wax/resin mixture) may be conveyed by an air stream to the forming head, which processes the furnish to form a mat 122. Making door skins of with less wood may allow for using less material for the mat. Generally, the rate that the wood goes into the forming head may be varied depending on the downstream steps of pressing the skins. Preferably, the consistency of the hybrid poplar fiber reduces the need for adjustments to the former/shaving stages. This allows for rates of forming and shaving to be pre-set, with less down time required to adjust the system for differences due to the flow of the wood through the forming head or the nature of the wood as if forms the mat 123.

Generally, to prepare a thin-layer door skin, the mat is formed thicker than required, and the excess is removed by shaving. In an embodiment, the mat may be formed to be about 40% thicker than required. Making door skins that use less wood may comprise forming a thinner mat or shaving off more of the mat; the material shaved from the mat may then be recycled back into the starting mix.

In one embodiment, the mat may be pressed at a reduced thickness 123. For example, to form a thinner mat, the rate that wood goes into the forming head may be reduced per door skin. In this way, less wood is deposited as the mat. The material shaved off of the mat is not discarded, but is recycled back into the system to generate additional mats (FIG. 1). However, because the recycled fiber has been treated with resin, the fiber going back into the system may have a tendency to dry out and lose tack. In an embodiment, shaved fiber is collected and rerouted back into the pressing system for a predetermined number of times. For example, in an embodiment, the percentage of fiber recycled more than 4 times comprises 20% or less of the total fiber. In other embodiments, the percentage of fiber recycled more than 4 times may comprise 10% or less of the total fiber, or 5% or less of the total fiber.

Once the mat is formed, the mat may be pre-compressed to a predetermined thickness prior to pressing the thin-layer composite 124. In an embodiment, a 5 inch mat comprising hybrid poplar may be pre-compressed as a mat that ranges from 0.75 to 3 inches in thickness. For example, the pre-compressor may presses the mat to a thickness of about 0.5 inches (12.7 mm). In an embodiment, mats made using the hybrid poplar are characterized by an increase in spring or pliability 125. In an embodiment, the increase in mat pliability is associated with increase resilience during the final pressing and stack steps. For example, a mat that is too dense may crack when pressed between the dies.

After the mat has be pre-pressed, it may cut to the proper width and length to fit in a platen press, where the mat is compressed between two dies under conditions of increased temperature and pressure to form the molded skin. For cutting the mat 124, trim saws may used to cut the edges to the proper width, and a flying cut-off saw may be used to cut the mat to the proper length. In an embodiment, a gentle vacuum may be used to remove the material that has been trimmed from the mat. In the embodiment where a mat of reduced thickness is used, the amount of material removed and recycled is reduced, thus reducing wear on the vacuum.

Due to the reduced density of the skin, the glue that is used to stick the skin to the underlying door frame during manufacture of the door can penetrate into the pores of the door skin pores resulting in poor adhesion of the door skin to the frame, or difficulties in subsequent treatments, such as painting or priming the door skin. Thus, in one embodiment, a sealer may be added to at least one surface of the pre-compressed mat prior to pressing the mat between the dies 126. As described above, in some cases the external release agent sprayed on the mat acts as a sealer. The sealer can act to seal the surface of the mat, thereby resulting in door skins of a more consistent surface quality. The sealer may be sprayed on the top side of the mat. Alternatively, sealer may be sprayed on both surfaces of the mat.

Once the mats have been pressed, they may be introduced into the platen press 130. In one embodiment, to form the less dense door skins of the present invention, a reduction in press time may be employed 131. For example, the manufacture of door skins having density reduced by 10% may reduce total press time by about 6 seconds (10%) per press cycle. For the press conditions typically used to make door skins, taking only 1 second out of the press cycle may result in an increase of 280 door skins made per day. In one embodiment, reducing the door skin density from 61 pcf to 56 pcf by using hybrid poplar as a source of lignocellulosic fiber reduced the press cycle from 43 seconds to 38 seconds. Alternatively, press conditions used for standard door skins may be used.

The conditions used to form the thin-layer composite door skins of the present invention may include compressing the mixture at elevated temperature and pressure for sufficient time to allow the resin to interact with the wood fibers. The temperature used to press the mat may range from about 250° F. (121° C.) to about 400° F. (204° C.). In other embodiments, the temperature used to press the mat may range from about 280° F. (138° C.) to about 350° F. (177° C.) or from about 290° F. (143° C.) to about 330° F. (166° C.). The exact conditions used will depend upon the equipment used, the exterior environment (e.g., temperature, elevation), the manufacturing schedule, the cost of input resources (e.g., starting materials, electric power), and the like. Also, changes in pressure may require adjustment of the time and/or temperature used for pressing.

Similarly, the levels of the pressure applied during the pressing of the thin-layer composite may vary depending on a variety of factors, such as the nature of the thin-layer composite that is being formed, the temperature(s) used for pressing, the equipment being used, environmental conditions, production capabilities, and the like. Thus, in one embodiment, the pressure during the pressing step may range from about 2500 psi (176 kg/cm$^2$) to about 150 psi (10.5 kg/cm$^2$). In another embodiment, the pressure may be applied in a step-wise manner. For example, the pressure during the pressing step may range from about 1200 psi (84.3 kg/cm$^2$) for about 5 to 20 seconds followed by 500 psi (35.16 kg/cm$^2$) for 15 to 80 seconds. For example, in one embodiment, the pressure during the pressing step ranges from about 1200 psi (84.3 kg/cm$^2$) for about 10 seconds to about 500 psi (35.16 kg/cm$^2$) for about 24 seconds.

In some cases, the resin used to make the thin-layer composites of the present invention may cause the composite to stick to the surface of the die used to press the composite into a thin-layer. Thus, in one embodiment, the method of the present invention may comprise the step of spraying at least one of the dies with an anti-bonding agent 128 or spraying at least one surface of the mat with a release agent as described above. For thin-layer door skins, the die that is coated with the anti-bonding agent may correspond to the die used to press the outside surface of the door skin. Alternatively, both dies may be coated with an anti-bonding agent.

The amount of anti-bonding agent used to coat the die surface may range in thickness from about 0.0005 to about 0.010 inches (i.e., about 0.0127 mm to about 0.254 mm). Thus, in one embodiment, the amount of anti-bonding agent used to coat the die surface comprises about 0.003 inches (i.e., about 0.0762 mm).

In one embodiment, coating the die may comprise baking the anti-bonding agent onto the die surface. For example, the step of baking the anti-bonding agent onto the die surface may comprise the steps of: (i) cleaning the die surface free of dirt, dust and grease; (ii) spraying a solution of the anti-bonding agent onto the die, e.g., from about 0.0005 to 0.010 inches (0.0127 to 0.254 mm) of a 50% solution; and (iii) baking the die, e.g., at greater than 300° F. (149° C.) for about 1 to 4 hours. In an embodiment, the step of cleaning the die comprises cleaning the die surface with a degreaser, wire brushing to remove solids, wiping the die surface with a solvent (such as acetone), and buffing with a cotton pad. Under suitable conditions, the anti-bonding agent that is baked onto the die (or dies) is stable enough to the pressing conditions such that the die(s) can be used for over 2,000 pressing cycles prior to requiring a second coating with additional anti-bonding agent.

Other equivalent methods to facilitate non-sticking of the lignocellulose composite to the surface used to press the composite into a thin layer may be incorporated into the methods of the present invention. For example, to facilitate release of a door skin from the dies used to press the door skin, the die(s) may be nickel plated, chrome plated, covered with a ceramic layer, or coated with fluorocarbons.

Also in an embodiment, the dies are carefully aligned prior to pressing to prevent sticking of the door skins to the dies. By carefully aligning the dies prior to pressing the door skin, shearing of the door skin is reduced. Thus, in an embodiment, preparation of the door skins of the present invention is associated with close monitoring of the die alignment step.

Next the door skins may be removed from the surface of the press using a rotor to lift the skins from the surface of the press 132. The lighter, less dense door skins of the present invention may require less force to remove the door skins from the press than would be required for door skins that are not made using hybrid poplar. The rotor used to push the door skin out of the press may be slowed down on initial contact with the door skin, and then increased to its normal rate. This allows the door skin to be gently loosened prior to its removal from the press.

The door skins may then be stacked for shipping 134. In an embodiment, the door skins of the present invention may comprise about 9 to 20% less weight per door skin than door skins that do not use hybrid poplar fiber. This may allow for an increase in the number of door skins shipped per truck 135. For example, with a reduction in weight of about 10%, about 4,050 door skins of 30 inch width may be shipped in a standard truck with an enclosed trailer, as opposed the maximum limit of 3,600 standard 0.125 inch (3.175 mm) door skins of the same width, where the enclosed volume in the truck measures 52 feet 5.5 inches (16 m) in length by 101 inches (2.6 m) in width and 110 inches (2.8 m) in height at the front of the bed and 112.25 inches (2.85 m) at the rear of the bed.

Also, because the door skins of the present invention are lighter in weight, they may be easier to handle. Thus, a standard 36 inch (0.91 m) by 80 inch (2.0 m) door skin that is 0.125 inches (3.175 mm) thick and made to fit a standard door frame weighs approximately 12.4 pounds (5.62 kg). In contrast, the thinner door skins of the present invention weigh about 10.8 to 11.2 pounds (about 4.9 to 5.09 kg). This reduction in weight can make the door skins easier to flip and stack for packing 135.

The improved consistency of the hybrid poplar fibers and the increased pliability of the skins produced may also be associated with less breakage of the final product. Thus, in an embodiment, door skins made using greater than 40% hybrid poplar exhibit reductions in breakage of over 50%.

Referring still to FIG. 2, next, the door skins of the present invention may be attached to an underlying frame to form a door 136. In an embodiment, the less dense door skins of the present invention still swell and shrink with the loss and gain of moisture, but when attached to a door frame 136, do not exert as much force on the door frame upon shrinkage and expansion of the door skin 137. Thus, the door skins of the present invention are not as likely to bend the door frame as thicker door skins.

EXAMPLE

Using the method of producing door skins outlined above, door skins ranging from about 35% to about 51% hybrid poplar (hybrid *Populus*) may be made. To produce door skins comprising hybrid *Populus*, a standard production line may be employed with the modifications described herein. For wood chips having hybrid *Populus* at levels greater than 25%, the green (non-dried) *Populus* chips may be stored separately prior to mixing with other types of wood chips. After mixing the chips and sifting to remove fines, any excess moisture may be drained via the plug feeder prior to refining.

In addition to improved consistency, several beneficial characteristics have been noted for door skins made using 25% or more *Populus*. It was found that the fiber generated from hybrid poplar exhibited substantial reduction in the number of shives, defined as large fiber bundles greater than 0.006 inches (0.15 mm) wide (14 mesh) (Table 1).

TABLE 1

Levels of Fiber Bundles (% Shives) in Fiber Derived From Various Sources

| Fiber Species/Location | % Shives |
|---|---|
| Hybrid poplar | 4.94 |
| Urban wood (from building demolition) | 19.16 |
| Non-poplar based wood chips (WA) | 10.54 |
| Non-poplar based wood chips (NC) | 8.90 |

It was also found that the bulk density of fiber made from hybrid poplar is reduced compared to fiber from ponderosa pine wood waste (a common source of wood for door skins).

Thus, using standard refining techniques such as those employed in the manufacture of door skins, hybrid poplar fiber was found to have an average bulk density of 1.54 pcf, whereas pine fiber has an average bulk density of 2.0 pcf. (Table 2).

TABLE 2

Density of *Populus* Fiber and Pine Fiber

| Fiber type | Density range (pcf) | Average density (pcf) |
|---|---|---|
| Hybrid poplar fiber | 1.4-2.0 | 1.54 |
| Pine fiber | 1.8-2.6 | 2.0 |

Further, it was found that door skins made with hybrid poplar comprise significantly less breakage than door skins made with conventional fibers. For example, rejects due to skin breakage have been reduced by at least 50% when using hybrid poplar at an amount of 40% or more of skin weight.

It was found that door skins made using 25% to 40% hybrid poplar could be formulated at a minimum density of 51 pcf (817 kg/m$^3$) or lower, as compared to 62 pcf (993 kg/m$^3$) for standard door skins made with pine wood waste. Also, the door skins containing 25% to 40% hybrid poplar could be made at a thickness of to 0.09 inches (2.29 mm) as compared to a minimum of 0.1 inch (2.54 mm) for standard pine door skins. The resulting door skins were also associated with a reduction in total resin content from an average of about 0.807 pounds for standard pine door skins measuring 30 inches by 80 inches by 0.125 inches in thickness at 62 pcf density and 7.5% resin solids, to an average of about 0.764 pounds for door skins containing hybrid poplar that are 30 inches by 80 inches by 0.125 inches thick at 55 pcf density and 8.0% resin solids.

It will be understood that each of the elements described above, or two or more together, may also find utility in applications differing from the types described. While the invention has been illustrated and described as molded thin-layer lignocellulose composites made using hybrid poplar and methods of making such structures, it is not intended to be limited to the details shown, since various modifications and substitutions can be made without departing in any way from the spirit of the present invention. As such, further modifications and equivalents of the invention herein disclosed may occur to persons skilled in the art using no more than routine experimentation, and all such modifications and equivalents are believed to be within the spirit and scope of the invention as described herein.

What is claimed is:

1. A method for making a thin-layer lignocellulosic composite comprising a predetermined amount of hybrid poplar (hybrid *Populus*) comprising the steps of:

(a) forming a mixture comprising a refined lignocellulose fiber comprising a predetermined amount of hybrid poplar fiber, a resin, a release agent that will not interfere with subsequent processing of the thin-layer lignocellulosic composite, and at least one type of wax;

(b) pre-pressing the mixture into a loose mat; and (c) pressing the mat between two dies at an elevated temperature and pressure and for sufficient time to form a thin-layer lignocellulosic composite, wherein at least one of the two dies is coated with an anti-bonding agent comprising at least one silicone and/or silane based chemical.

2. The method of claim 1, wherein the hybrid poplar comprises the total lignocellulose fiber used in the thin-layer composite.

3. The method of claim 1, wherein the hybrid poplar fiber ranges from about 40% to about 75% of the total lignocellulose fiber used in the thin-layer composite.

4. The method of claim 1, wherein the hybrid poplar fiber ranges from about 40% to about 55% of the total lignocellulose fiber used in the thin-layer composite.

5. The method of claim 1, wherein the total lignocellulose fiber ranges from about 80% to about 95% by weight of the thin-layer composite.

6. The method of claim 1, wherein the step of forming a mixture comprising a refined lignocellulose fiber-comprising a predetermined amount of hybrid poplar fiber, a resin, a release agent and at least one type of wax comprises spraying at least one surface of the mat with a release agent prior to pressing the mat.

7. The method of claim 1, further comprising adding a pre-press sealer to at least one surface of the mat prior to pressing the mat.

8. The method of claim 1, wherein the final density of the thin-layer lignocellulosic composite ranges from about 45 pounds per cubic foot to about 58 pounds per cubic foot.

9. The method of claim 1, wherein the final density of the thin-layer lignocellulosic composite ranges from about 51 pounds per cubic foot to about 56 pounds per cubic foot.

10. The method of claim 1, wherein the thickness of the thin-layer lignocellulosic composite ranges from about 0.05 inches to about 0.5 inches.

11. The method of claim 1, wherein the thickness of the thin-layer lignocellulosic composite ranges from about 0.08 inches to about 0.2 inches.

12. The method of claim 1, wherein the thickness of the thin-layer lignocellulosic composite ranges from about 0.09 inches to about 0.115 inches.

13. The method of claim 1, wherein the thin-layer lignocellulosic composite comprises a door skin.

14. The method of claim 13, wherein the lignocellulose used to generate the refined fibers comprises less than 20% fines, wherein fines comprise particles able to pass through a 1/16 inch by 1/16 inch (1.59 mm by 1.59 mm) mesh.

15. The method of claim 13, wherein the use of hybrid poplar fiber results in a reduction in the workload for the refiner used to refine the fiber in the range of 5% to 20% as compared to a door skin having less than 1% hybrid poplar wood.

16. The method of claim 13, wherein the use of hybrid poplar fiber results in a reduction in the amount of resin per door skin in the range of about 5% to 20% as compared to a door skin having less than 1% hybrid poplar wood.

17. The method of claim 13, wherein the use of hybrid poplar fiber results in a reduction in the weight per door skin in the range of about 5% to 20% as compared to a door skin having less than 1% hybrid poplar wood.

18. A method for making a thin-layer lignocellulosic composite comprising a predetermined amount of hybrid poplar (hybrid *Populus*) comprising the steps of:

(a) forming a mixture comprising a refined lignocellulose fiber comprising a predetermined amount of hybrid poplar fiber, a resin, at least one type of wax, and, optionally, a release agent that is distinct from the wax and that will not interfere with subsequent processing of the thin-layer lignocellulosic composite;

(b) pre-pressing the mixture into a loose mat; and (c) pressing the mat between two dies at an elevated temperature and pressure and for sufficient time to form a thin-layer lignocellulosic composite, wherein at least one of the two dies is coated with an anti-bonding agent comprising at least one silane and/or silicone based chemical.

* * * * *